US009108087B2

(12) United States Patent
Hornung

(10) Patent No.: US 9,108,087 B2
(45) Date of Patent: Aug. 18, 2015

(54) REMOTE CONTROLLED GOLF BALL MARKER PUTTING-ALIGNMENT DEVICE

(71) Applicant: William V. Hornung, Tucson, AZ (US)

(72) Inventor: William V. Hornung, Tucson, AZ (US)

( * ) Notice: Subject to any disclaimer, the term of this patent is extended or adjusted under 35 U.S.C. 154(b) by 0 days.

(21) Appl. No.: 14/269,645

(22) Filed: May 5, 2014

(65) Prior Publication Data

US 2015/0045131 A1 Feb. 12, 2015

Related U.S. Application Data

(60) Provisional application No. 61/863,808, filed on Aug. 8, 2013.

(51) Int. Cl.
*A63B 69/36* (2006.01)
*A63B 57/00* (2015.01)

(52) U.S. Cl.
CPC ..... *A63B 57/0075* (2013.01); *A63B 69/3676* (2013.01); *A63B 2225/20* (2013.01); *A63B 2243/0029* (2013.01)

(58) Field of Classification Search
CPC ..... A63B 69/3676; A63B 69/3655; A63B 57/0075; A63B 69/3623
USPC ..... 473/218, 219, 266, 238, 249, 251, 252, 473/254, 225, 257, 285, 340, 404, 405, 406, 473/407
See application file for complete search history.

(56) References Cited

U.S. PATENT DOCUMENTS

| | | | | |
|---|---|---|---|---|
| 3,553,871 | A | 1/1971 | Benchley | |
| 3,934,882 | A * | 1/1976 | Whittaker | 473/257 |
| 5,356,133 | A * | 10/1994 | Bellagamba | 473/406 |
| 5,422,638 | A | 6/1995 | Singer et al. | |
| 5,437,446 | A | 8/1995 | Youngkin | |
| 5,959,554 | A | 9/1999 | Armstrong et al. | |
| 6,104,313 | A | 8/2000 | Boyd, II | |
| 7,384,345 | B2 | 6/2008 | Sherman | |
| 2006/0247071 | A1 | 11/2006 | Womersley | |
| 2009/0186721 | A1 | 7/2009 | Kramski | |
| 2009/0227396 | A1 * | 9/2009 | Bronson | 473/407 |
| 2009/0305817 | A1 * | 12/2009 | Cameron | 473/406 |
| 2010/0130299 | A1 * | 5/2010 | Womersley et al. | 473/268 |
| 2013/0106619 | A1 | 5/2013 | Williams | |

FOREIGN PATENT DOCUMENTS

WO 2013/041644 A1 3/2013

* cited by examiner

*Primary Examiner* — Nini Legesse
(74) *Attorney, Agent, or Firm* — Lewis Roca Rothgerber LLP

(57) ABSTRACT

A putting alignment device includes a base, a cap mounted to the base for rotation with respect to the base, and alignment indicia on the cap which indicates a target line for putting a golf ball. A remote control unit is coupled in communication to the base to issue instructions to the base. The device includes drive means in the base which rotate the cap with respect to the base in response to a signal communicated from the remote control unit, so as to move the alignment indicia according to instructions carried in the signal from the remote control unit.

20 Claims, 6 Drawing Sheets

REMOTE CONTROLLED GOLF BALL MARKER PUTTING-ALIGNMENT DEVICE

CROSS-REFERENCE TO RELATED APPLICATIONS

This application claims the benefit of U.S. Provisional Application No. 61/863,808, filed Aug. 8, 2013, which is hereby incorporated by reference.

FIELD OF THE INVENTION

The present invention relates generally to golf, and more particularly to equipment for aiming a golf ball during a putt.

BACKGROUND OF THE INVENTION

Accuracy and patience are vitally important in the play of golf. The sport depends on careful alignment of the club or putter with the eye, the body to the ball, and the ball with the hole or a target line. Particularly during putting, a golfer will often agonize over alignment, checking and re-checking that his body is properly addressing the ball and that the face of his putter is properly aligned with the target line extending from the ball outward to the intended target. Often times, the target line is not directly toward the hole, but instead falls to the side of the hole, perhaps because of a rise or a fall in the green or because of some other irregularity that the golfer wishes to accommodate.

Alignment of the ball is a crucial but frustrating process. The golfer will often stoop down to line the ball up just right, putting his eyes behind the ball to visualize the line it will take to the hole. He then attempts to remember that target line, gets up, and addresses the ball, hoping to hit the ball along the target line. However, in the process, he unavoidably loses the perspective he had when he was low and behind the ball, and he may also lose the visualized target line as well. To counteract this, many players use balls with lines marked on the circumference of the ball for alignment. They will arrange and rotate the ball so that the line on the ball is aligned with the target line. This can help those players address the ball in alignment to the target line and may help them putt more precisely.

Unfortunately, it is often quite difficult to arrange the ball correctly and accurately. Alignment is ultimately limited by the accuracy with which the golfer can gauge the target line while addressing the ball. When alignment arrangements are finalized, the golfer is next to the ball and must take care to align one of his eyes over the ball and along the target line. When close to the ball and standing over it, precise alignment is extremely difficult and makes putting accurately one of golf's greatest challenges. Minor perception errors and accidental adjustments to one side or the other can cause the ball to take a much different path than along the target line. Moreover, golfers who wear corrective lenses or other protective eyewear may have their peripheral vision distorted by the optics covering their eyes, which can make alignment even more difficult.

Additionally, putting is one of the slowest processes in golf, demanding an immense amount of patience. A device that enables a golfer to quickly align his putts and gives him total confidence in his alignment at the time he addresses the ball to putt would dramatically reduce the time it takes to play a round of golf. This would let golfers play more and let golfers waiting behind putting golfers endure less lengthy alignment sessions. This will give added enjoyment to golfers and increase the revenue of golf courses due to the efficiencies of speedy play. An improved device for aiding golfers in aiming the ball quickly and accurately is needed.

SUMMARY OF THE INVENTION

According to the principle of the invention, a remote controlled golf ball marker alignment device includes a marker and a remote control unit. The marker bears alignment indicia for aligning with a target line along which the golfer has chosen he would like to hit the ball. The marker consists of a base and a cap mounted to the base for rotation. The cap carries the alignment indicia, so that the alignment indicia can be rotated to indicate the target line for putting the golf ball. The remote control unit is coupled in communication to the base, and drive means within the base rotate the alignment indicia with respect to the base in response to a signal communicated from the remote control unit when the golfer operates the remote control unit from a distance providing him a vantage point to sight the target line.

BRIEF DESCRIPTION OF THE DRAWINGS

Referring to the drawings.

DETAILED DESCRIPTION

Figure 1:
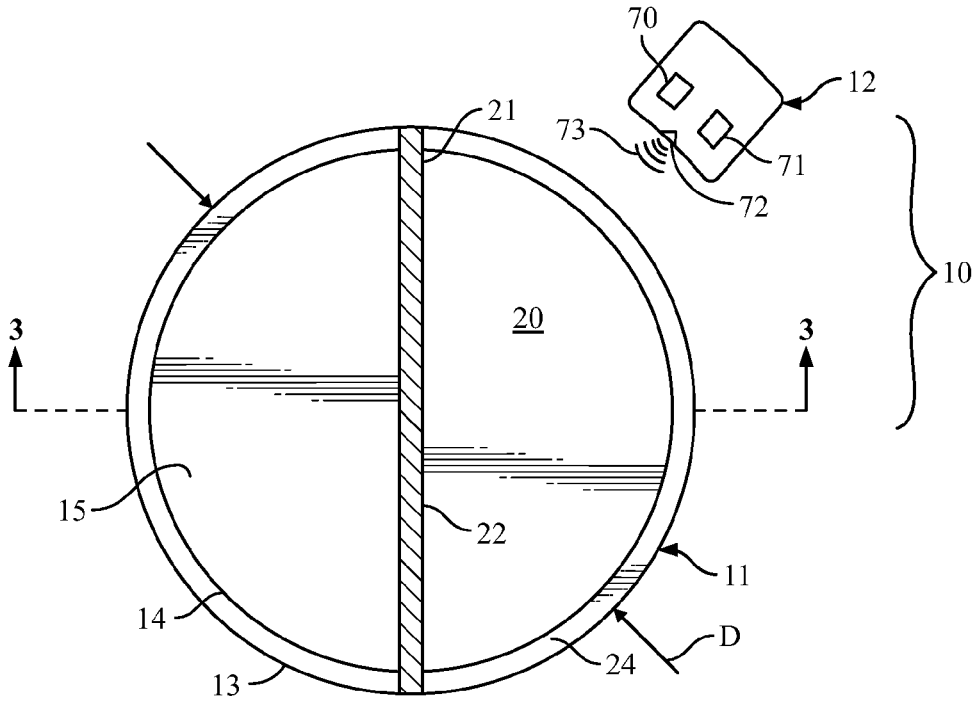
FIG. 1 is a top plan view of an embodiment of a remote controlled golf ball marker alignment device constructed and arranged according to the principle of the invention and including a cap mounted to a base.

Reference now is made to the drawings, in which the same reference characters are used throughout the different figures to designate the same elements. FIG. 1 is a top plan view of a remote controlled golf ball marker alignment device 10 structured and arranged according to an embodiment of the present invention, and including a marker 11 and a remote 12. The device 10 is useful for assisting a golfer in aligning a golf ball when putting. The marker 11 includes a cylindrical base 13 and a round cap 14 mounted to the base 13 for rotation with respect to the base 13. The device 10 is structured to provide distanced viewing and alignment of a golf ball for accurate putting along a target line, and can also be used simply as a marker. Golfers frequently carry coins, tees, and other small items in their pockets, and the device 10 is sized small so as to be easily carried in a golfer's pocket.

The marker 11 of the device 10 is laid on the ground proximate to a golf ball to indicate a target line and direction along which the golf ball should be hit. The cap 14 of the marker 11 has a flat top 15 and a generally flat, circular upper face 20 carrying alignment indicia 21. The alignment indicia 21 indicates a target line for putting the golf ball when the golfer is standing above or behind the marker 11. The cap 14 is rotated on the base 13 so as to move the cap 14, and the alignment indicia 21 on the cap 14, in either of clockwise or counter-clockwise directions so as to direct the alignment indicia 21 along a selected alignment corresponding to the golfer's chosen target line. The alignment indicia 21 is preferably a solid, distinct, straight line extending diametrically across the upper face 20 and through a geometric center 22 of the upper face 20. The upper face 20 preferably has a first color, and the alignment indicia 21 has a second color which has a high contrast characteristic with the first color of the upper face 20, such as black on white, yellow on black, white on blue, etc. The alignment indicia 21 also preferably has a glossy characteristic, while the upper face 20 has a matte finish, so that the alignment indicia 21 is set off and further contrasts with the upper face 20. In other embodiments, the alignment indicia 21 has a matte finish and the upper face 20 has a glossy finish. In still other embodiments, the alignment indicia 21 is raised above the upper face 20 or is recessed below the upper face 20 to provide additional visual contrast. In yet still other embodiments according to the principle of the invention, the alignment indicia 21 includes other structures and features to display a line or show alignment, such as a series of broken lines, directional arrows, embedded LEDs, or like indicia.

Figure 3:
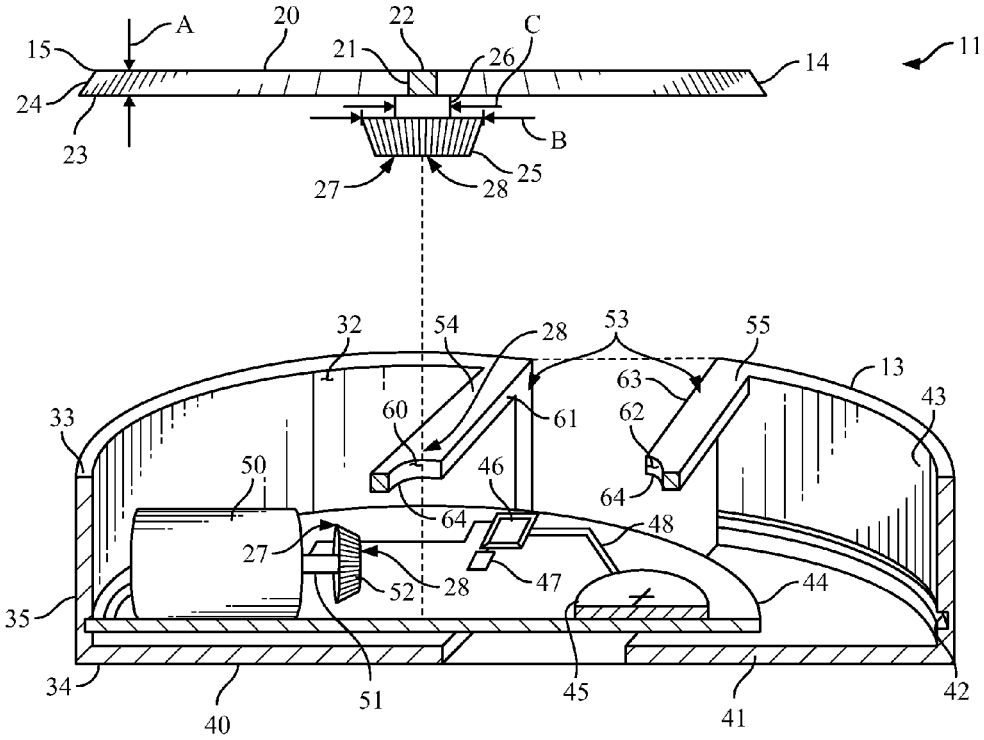
FIG. 3 is a partially exploded, partial section view of the device of FIG. 1 taken along the line 3-3 in FIG. 1.

FIG. 3 illustrates an exploded section view of the marker 11 taken along the line 3-3 of FIG. 1, clearly showing the base 13 and the cap 14 above the base 13. Now referring to FIG. 3, and also to FIG. 1, the cap 14 has a bottom 23 opposed from the top 15, which bottom 23 is generally flat across its entire dimension. The cap 14 has a thickness A between the top 15 and bottom 23, and includes a peripheral, annular bevel 24 extending continuously around the cap 14 and angled outwardly from the top 15 to the bottom 23. The alignment indicia 21 extends diametrically and entirely across the upper surface 20, and beyond the upper surface 20 onto the bevel 24. While in the embodiment shown in FIGS. 1 and 3, the cap 14 has a flat top 15, in other embodiments, the cap 14 is slightly convex.

A bevel gear 25 depends from the bottom 23 of the cap 14 at the geometric center 22 of the cap 14. The bevel gear 25 is mounted securely on a shaft 26 extending from the bottom 23 of the cap 14 and is fixed on the shaft 26. The bevel gear 25 is an external bevel gear and has an outer diameter B which is greater than a diameter C of the shaft 26. The bevel gear 25 is an element of a drive assembly 27 of the marker 11 and is also an element of an engagement assembly 28 of the marker 11, as will be explained in detail later. The cap 14 itself has a diameter D. The cap 14 is preferably monolithic, and is constructed of a material or combination of materials having light, low-density material characteristics, such as plastic, metal, or like materials. The cap 14 is preferably manufactured in a single-shot molding process.

Figure 2:
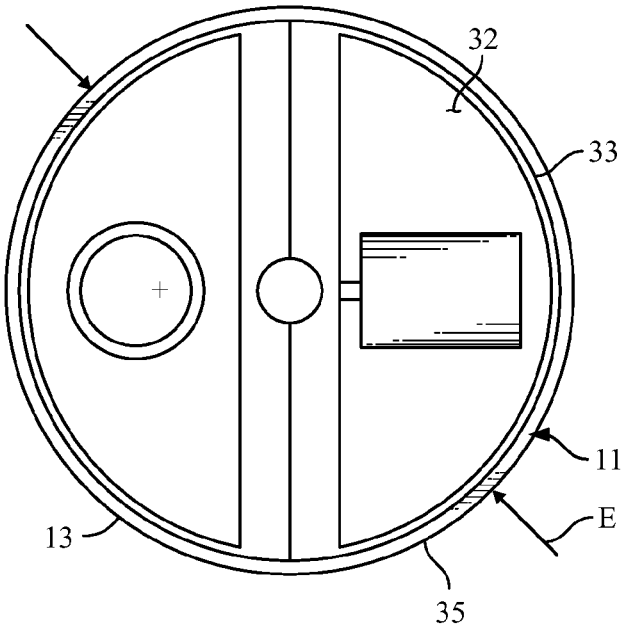
FIG. 2 is a top plan view of the device of FIG. 1 with the cap removed.

Referring to FIG. 2 and FIG. 3, the base 13 is a cylindrical base with an internal volume 32 for holding and protecting electronic and mechanical drive components. The base 13 has an open top 33, an opposed bottom 34, and a cylindrical sidewall 35 extending between the top 33 and bottom 34 and enclosing the internal volume 32. The base 13 has an outer diameter E of the sidewall 35 which is constant between the top 33 and bottom 34 and equal to the diameter D of the cap 14.

The base 13 is formed by first and second base portions 40 and 41 releasably secured to each other. Each base portion 40 and 41 shown in FIG. 3 is roughly half the size of the entire base 13, but it should be understood that the invention is not limited to base portions 40 and 41 which are exactly half the size of the entire base 13. The base portions 40 and 41 are opposed and releasably secured and coupled to each other to form the base 13. When coupled, the base potions 40 and 41 cooperate to define the base 13 with the continuous sidewall 35. An annular channel 42 extends continuously around an inner face 43 of the sidewall 35. The channel 42 is a generally rectangular groove extending into the sidewall 35 from the inner face 43, and is disposed proximate to the bottom 34 of the base 13. The base 13 is constructed of a material or combination of materials having light, low-density material characteristics, such as plastic, metal, or like materials.

Inside the base 13, the internal volume 32 contains and protects the electronic and mechanical drive components. A circular printed circuit board ("PCB") 44 is seated within the channel 42 and held in place, disposed just above the bottom 34 of the base 13 in the channel 42. The channel 42 is sized to snugly receive the PCB 44. The PCB 44 is fixed in the channel 42 on the first portion 40, such as by adhesive, and is snugly but releasably fit into the channel 42 on the second portion 41, so that, when the first and second portions 40 and 41 are detached from each other, the PCB 44 remains applied to the first portion 40. When the first and second base portions 40 and 41 are applied to each other, the PCB 43 snugly fits into the second base portion 41 and holds the second base portion 41 against and to the first base portion 40. The snug fit requires the first and second portions 40 and 41 to be pulled apart with force to release and disassemble the base 13. The PCB 44 carries a battery 45, programmable logic 46, a receiving unit 47, and circuit paths 48 connecting the battery 45, logic 46, and receiving unit 47. The battery provides power to the logic 46 and to the receiving unit 47, which is coupled in wireless communication, such as RF communication, with the remote 12. Mounted atop the PCB 44 is also the motor 50. The motor 50 is a drive motor having a shaft 51 and a bevel gear 52 spaced apart from the motor 50 and above the PCB 44 by the shaft 51. The motor 50 and bevel gear 52 define elements of the drive assembly 27 of which the bevel gear 25 on the cap 14 has previously been identified as an element. The motor 50 is preferably a DC motor which converts direct current electricity provided by the battery 45 into mechanical rotational movement of the shaft 51. The motor 50 may also be a piezoelectric or other small motor capable of minute rotational movement. The shaft 51, mounted for rotation in and by the motor 50, extends laterally and parallel with respect to the PCB 44 into the bevel gear 52. When the marker 11 is assembled, the bevel gears 25 and 52 of the drive assembly 27 meshingly engage so that rotation of the shaft 51 by the motor 50 imparts rotation to the cap 14. In other embodiments, the motor 50 may be aligned vertically with a shorter shaft 51 for driving a gear meshingly engaged with the bevel gear 25.

The base 13 further includes a brace 53 bifurcated into opposing spars 54 and 55 on the base portions 40 and 41, respectively, the spars 54 and 55 cooperating to form the brace 53. The spars 54 and 55 each span the entire open top 33 of the base 13. The spar 54 is a generally rectangular, elongate member extending across the top 33 and formed to the sidewall 35. The spar 54 has a semicircular notch 60 (shown in FIG. 3 in section view as a quarter notch) extending into the spar 54 from an inner face 61 of the spar 54. Likewise, the spar 55 is a generally rectangular, elongate member extending across the top 33 and formed to the sidewall 35. The spar 55 has a semicircular notch 62 (shown in FIG. 3 in section view as a quarter notch) extending into the spar 55 from an inner face 63 of the spar 55. Together, when the marker 11 is assembled, the spars 54 and 55 define the brace 53 with a central collar 64 formed by and between the notches 60 and 62. The central collar 64 receives the shaft 26 of the cap 14 when the marker 11 is assembled. The central collar 64 has a diameter equal to the diameter C of the shaft 26 on the cap 14. Additionally, the spars 54 and 55 each have a vertical thickness corresponding to the distance between the bevel gear 25 and the bottom 23 of the cap 14. In this way, when assembled, the shaft 26 is snugly fit in the central collar 64 and resists vertical movement and lateral movement, thereby holding the cap 14 to the base 13. Therefore, the bevel gear 25, the bevel gear 52, and the central collar 64 are elements of the engagement assembly 28 which hold the cap 14 to the base 13; vertical interaction of the bevel gear 25 against the central collar 64 prevents the cap 14 from lifting off the base 13, and lateral interaction of the bevel gear 25 against the central collar 64 prevents the cap 14 from sliding laterally off the base 13. Further, the engagement assembly 28, and the prevention of vertical or lateral movement of the cap 14, ensures that the drive assembly 27 of the bevel gears 25 and 52 stays together, intact, and engaged so that activation of the motor 50 will impart rotation to the cap 14.

With reference now to both FIGS. 1 and 3, the battery 45 within the internal volume 32 is electrically coupled to the motor 50 and powers the motor 50 in response to the golfer's commands. Commands are issued from the golfer through the remote 12. The remote 12 has two inputs, illustrated in FIG. 1 as buttons 70 and 71. Depression of buttons 70 and 71 will cause the cap 14 to rotate incrementally with respect to the base 13 in a clockwise or counter-clockwise direction, respectively. The remote 12 may also include other buttons, such as to turn the marker 11 on, off, or to standby. The remote 12 has a transmitter 72, such as a radio transmitter, which, in response to depression of either one of the buttons 70 and 71, transmits a signal 73 to the marker 11. The receiver 47 on the PCB 44 within the internal volume 32 receives the signal 73, and the programmable logic 46 coupled to the receiver 47 converts the signal 73 into an electrical pulse to the motor 50. A power switch is coupled to the programmable logic and energizes or turns off the device 10. Preferably, depression of the button 70 is converted into a single electrical pulse to the motor 50 rotating the cap 14 in a clockwise direction. Similarly, depression of the button 71 is converted into a single electrical pulse to the motor 50 rotating the cap 14 in a counter-clockwise direction. In this way, the golfer can incrementally rotate the cap 14, and thus the alignment indicia 21, in discrete, very small clockwise or counter-clockwise increments, such as movements of approximately one degree. In some embodiments, continued depression of the buttons 70 or 71 will result in continuous and slow rotation of the cap 14.

In use, the golfer will carry the device 10 with him in his pocket or perhaps in his golf cart or in a pocket on his golf bag. When his ball falls on the putting green and he desires to hit the ball upon a particular, selected target line, he will use the device 10. The golfer reaches into his pocket and pulls the marker 11 out, and then places it on the ground just behind the ball. Under the rules of golf, this allows the ball to be moved, rotated, and even picked up. Typically, the golfer will pick the ball up. The golfer then moves behind the marker 11, by as little as one or two feet, but perhaps by as much as ten or twenty feet. Greater accuracy in aiming is gained when the golfer is further away from the marker 11, but the alignment indicia 21 becomes more difficult to see, and it becomes more difficult for the eye to detect fine or minor rotation of the alignment indicia 21 as the golfer walks further away from the marker 11. At a chosen distance behind the marker 11, the golfer stoops or crouches, so that he may best align one of his eyes along the ground and toward the marker 11.

The golfer then chooses, or has already chosen, a selected target line. This line may extend directly toward the hole, or it may be offset from the hole depending on the topology and conditions of the ground between the ball and the hole. While stooped or crouched, the golfer will discretely depress either the button 70 or the button 71 to rotate the cap 14 clockwise or counter-clockwise, respectively, so as to rotate the alignment indicia 21 in a clockwise or counter-clockwise direction in small, discrete increments. The golfer moves the alignment indicia 21 by small- or single-degree increments until he has aligned the alignment indicia 21 with the target line to his satisfaction.

Once the marker 11 is aligned, the golfer rises to his feet and walks back to the marker 11. The golfer places the ball back at its original location in front of the marker 11, taking care to align the ball with the marker 11. Typically, balls have at least a short line extending along the circumference; sometimes, golfers will mark the ball with a straight line on their own. The golfer aligns this line on the circumference of the ball with the alignment indicia 21 on the marker 11. Once aligned to the golfer's satisfaction, the golfer reaches down, removes the marker 11, and addresses the ball. He then precisely aligns the guideline on top of this putter with the line on the circumference of the golf ball. He putts the ball in the precise target line that he had chosen with the aid of the device 10 from his earlier vantage point well behind the ball.

Figure 4:
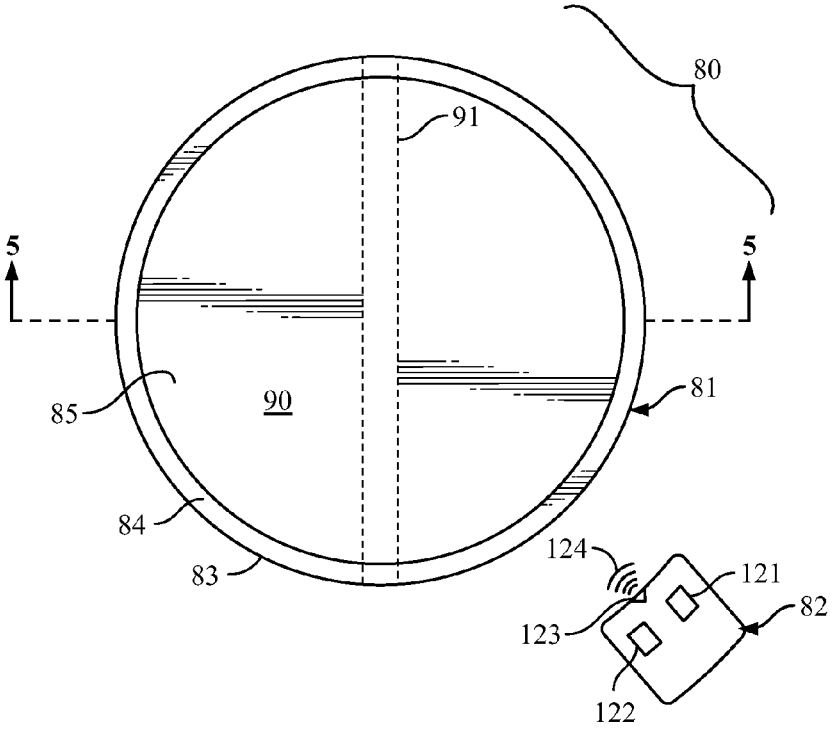
FIG. 4 is a top plan view of another embodiment of a remote controlled golf ball marker alignment device constructed and arranged according to the principle of the invention and including a cap mounted to a base.
Figure 5:
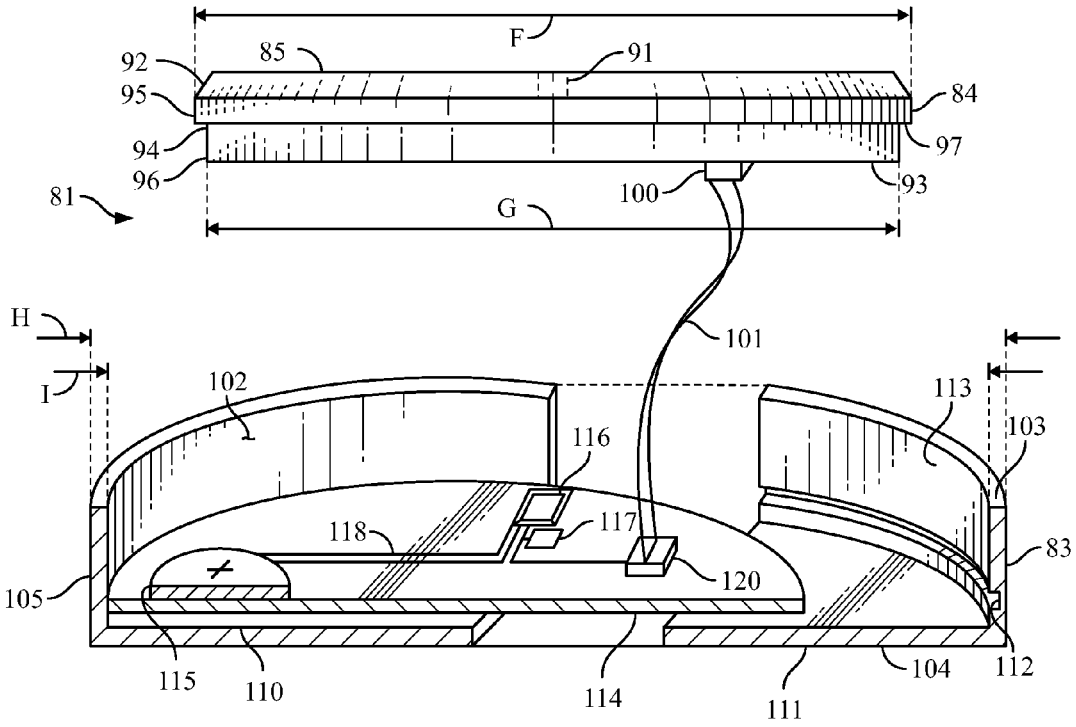
FIG. 5 is a partially exploded, partial section view of the device of FIG. 4 taken along the line 5-5 in FIG. 4.

FIGS. 4 and 5 illustrate a remote controlled golf ball marker alignment device 80 constructed and arranged according to an embodiment of the principle of the invention. Like the device 10, the device 80 is also useful for aligning a golf ball during putting. The device 80 includes a marker 81 and a remote 82. The marker 81 includes a cylindrical base 83, similar to the base 13, and a round cap 84. The device 80 is structured to provide distanced viewing and alignment of a golf ball for accurate putting along a target line.

The cap 84 has a flat top 85 and a flat, circular electronic visual display 90 for displaying alignment indicia 91. In other embodiments, the top 85 of the cap 84 may be slightly convex. The display 90 is a display illuminating pixels so as to form a pattern or other image, such as an LCD display. The display 90 extends across the top 85 of the cap 84 and over a bevel 92 at a perimeter edge of the cap 84. In FIG. 4, the display 90 displays the alignment indicia 91, marked therein by two parallel, broken lines signifying the outline of the alignment indicia 91. The alignment indicia 91 preferably is a collection of dark pixels bound within the two, parallel broken lines, and the display 90 displays white pixels outside of the zone occupied by the alignment indicia 91 so as to provide a high-contrast indicator of the target line. In embodiments in which the display 90 is capable of producing color, the display 90 may display the alignment indicia 91 in a contrasting color to the rest of the top 90, such as white on black, yellow on black, blue on white, or some other contrasting color scheme.

The cap 84 is fixed on the base 13 in a snug-fit engagement. FIG. 5 illustrates an exploded section view of the marker 81 taken along the line 5-5 in FIG. 4. The cap 84 has a bottom 93 opposed from the top, and a tiered sidewall 94 extending therebetween. The sidewall 94 has an upper portion 95 proximate to the top 85, an opposed lower portion 96 proximate to the bottom 93, and an annular shoulder 97 between the upper and lower portions 95 and 96. The upper portion 95 has an outer diameter F, the lower portion 96 has an outer diameter G which is less than F, and the shoulder is a horizontal transition between these diameters F and G. The lower portion 96 of the cap 84 is thus a boss or stud, albeit a wide and short stud, projecting from the upper portion 95 to the bottom 93 of the cap 84. A ribbon connector 100 is carried in the bottom 93 of the cap 84 and coupled electronically to the display 90. A ribbon cable 101 is connected to the ribbon connector 100 and extends to the base 83.

The base 83 is a cylindrical base with an internal volume 102 for holding and protecting electronic components. The base 83 has an open top 103, an opposed bottom 104, and a cylindrical sidewall 105 extending between the top 103 and bottom 104 and enclosing the internal volume 102. The base 83 has an outer diameter H of the sidewall 105 which is constant between the top 103 and bottom 104 and equal to the diameter F of the upper portion 95 of the cap 84. The base 83 has an inner diameter I of the sidewall 105 which is constant between the top 103 and bottom 104 and equal to the diameter G of the lower portion 96 of the cap 84. When assembled, the base 83 and the cap 84 are secured with a snug-fit engagement; the shoulder 97 is seated in continuous contact against the top 103 of the base 83, the lower portion 96 of the sidewall 94 is snugly received against the inner face 113 of the sidewall 105 of the base 83, and the diameter F of the lower portion 96 corresponds to and is just received within the inner diameter I of the base 83.

The base 83 is formed by first and second base portions 110 and 111. Both of the first and second base portions 110 and 111 are roughly half the size of the entire base 83, but it should be understood that the invention is not limited to base portions 110 and 111 which are exactly half the size of the entire base 83. The base portions 110 and 111 are opposed and releasably secured and coupled to each other to form the base 83. When coupled, the base potions 110 and 111 cooperate to define the base 83 with the sidewall 105. An annular channel 112 extends continuously around an inner face 113 of the sidewall 105. The channel 112 is a generally rectangular groove extending into the sidewall 105 from the inner face 113 and is disposed proximate to the bottom 104 of the base 83.

Inside the base 83, the internal volume 102 contains and protects the electronic components of the marker 81. A circular printed circuit board ("PCB") 114 is seated within the channel 112 and held in place, disposed just above the bottom 104 of the base 83 in the channel 112. The channel 112 is sized to snugly receive the PCB 114. The PCB 114 is fixed in the channel 112 on the first portion 110, such as by adhesive, and is snugly fit into the channel 112 on the second portion 111, so that, when the first and second portions 110 and 111 are detached from each other, the PCB 114 remains applied to the first portion 110. The PCB 114 carries a battery 115, programmable logic 116, a receiving unit 117, and circuit paths 118 connecting the battery 115, logic 116, and receiving unit 117. The battery 115 provides power to the logic 116 and to the receiving unit 117, which is coupled in wireless communication, such as RF communication, with the remote 82. The PCB 114 also includes a ribbon connector 120, to which the ribbon cable 101 is coupled, extending from the ribbon connector 100 on the cap 84. The ribbon connector 120 is also coupled by path 118 to the logic 116, so that the display 90 on the top 85 of the cap 84 is connected in electronic communication to the logic 116 to illuminate and alter the display 90 according to the instructions received wirelessly from the remote 82 operated by the golfer.

Still referring to FIG. 5, and also to the remote 82 shown in FIG. 4, the battery 115 within the internal volume 102 is electrically coupled to the display 90 through the ribbon cable 101 to provide the display 90 with power and to send and receive data from the display 90 in response to the golfer's commands. Commands are issued from the golfer through the remote 82. The remote 82 has two inputs, illustrated in FIG. 4 as buttons 121 and 122. Depression of buttons 121 and 122 will cause the display to re-arrange pixels displaying the alignment indicia 91 so that the alignment indicia 91 appears to rotate incrementally with respect to the base 83 in a clockwise or counter-clockwise direction, respectively. The remote 82 may also include other buttons, such as to turn the marker 81 on, off, or to standby. The remote 82 has a transmitter 123, such as a radio transmitter, which, in response to depression of either one of the buttons 121 and 122, transmits a signal 124 to the marker 81. The receiver 117 on the PCB 114 within the internal volume 102 receives the signal 124, and the programmable logic 116 coupled to the receiver 117 converts the signal 124 into a set of instruction data. That data is transmitted through the ribbon cable 101 to the display 90, which then displays the pixels. In FIG. 4, the pixels display alignment indicia 91 in a vertical orientation (with respect to the layout of the page). The display 90 is capable of appearing to rotate the alignment indicia 91 by increasing and decreasing the brightness of pixels just inside and outside of the zone shown in the alignment indicia 91 in FIG. 4. For example, by increasing the brightness of pixels near the top right and bottom left of the zone covered by the alignment indicia 91 in FIG. 4, and by decreasing the brightness of pixels just within the top left and bottom right of the zone covered by the alignment indicia 91 in FIG. 4, the alignment indicia 91 appears to rotate slightly clockwise. A power switch is coupled to the programmable logic and energizes or turns off the device 10. When powered on, the display 90 adopts a default display and arrangement of the alignment indicia 91, shown in FIG. 4. The display 90 has a high density of pixels and is capable of displaying minor rotational movement of the alignment indicia 91, but in a preferred embodiment, depression of the buttons 121 or 122 appears to rotate the alignment indicia 91 in small- or single-degree clockwise or counter-clockwise increments. The buttons 70 and 71 may also be depressed continuously to cause the alignment indicia 91 to rotate continuously and slowly.

Figure 6:
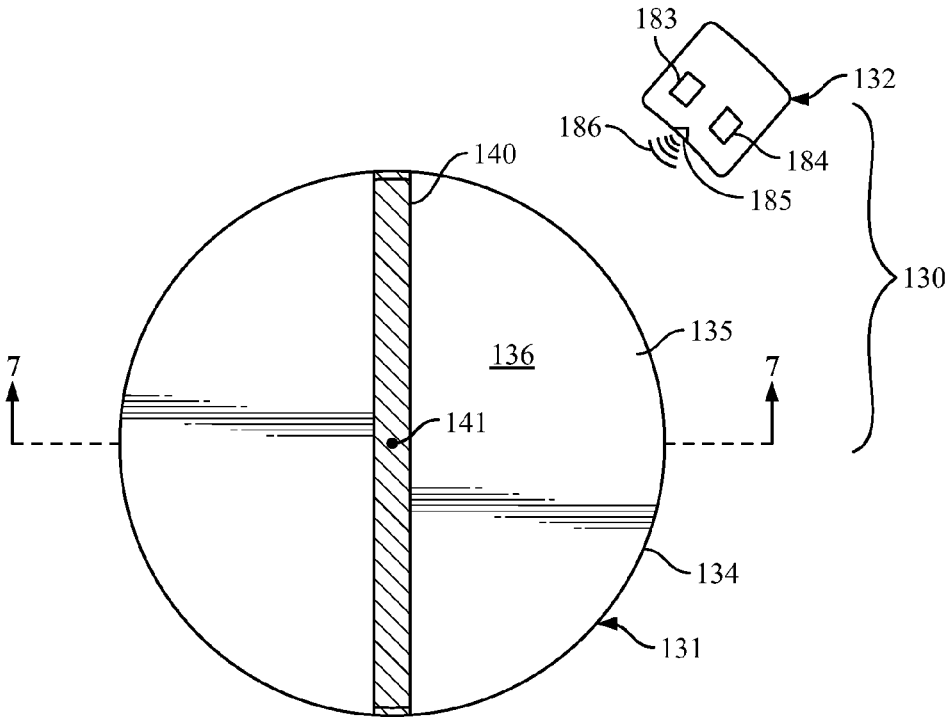
FIG. 6 is a top plan view of yet another embodiment of a remote controlled golf ball marker alignment device constructed and arranged according to the principle of the invention and including a cap mounted to a base and having a hand mounted for rotation with respect to the cap.
Figure 7:
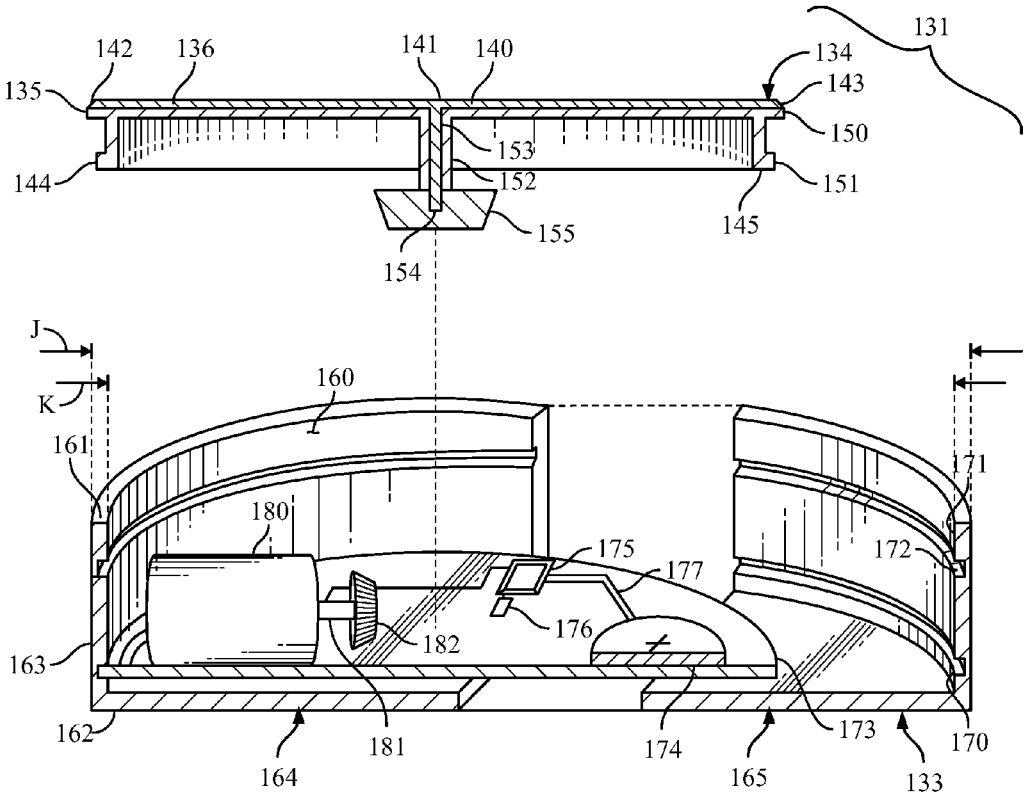
FIG. 7 is a partially exploded, partial section view of the device of FIG. 6 taken along the line 7-7 in FIG. 6

FIGS. 6 and 7 illustrate a remote controlled golf ball marker alignment device 130 constructed and arranged according to an embodiment of the principle of the invention. Like the devices 10 and 80, the device 130 is also useful for aligning a golf ball during putting. The device 130 includes a marker 131 and a remote 132. The marker 131 includes a cylindrical base 133, similar to the base 13, and a round cap 134. The device 130 is structured to provide distanced viewing and alignment of a golf ball for accurate putting along a target line.

The cap 134 has a flat top 135 with a generally flat, circular upper face 136 above which a hand 140 is disposed. The hand 140 is an alignment indicia in the form of a rigid, elongate member that rotates with respect to the cap 134 so as to provide an alignment for the golfer as he is standing above the marker 131. The hand 140 moves in clockwise and counter-clockwise directions so as to be oriented along a selected alignment corresponding to the golfer's chosen target line. The hand 140 extends diametrically across the upper face 140 and through a geometric center 141 of the upper face 136. The upper face 136 preferably has a first color, and the hand 140 has a second color which has a high contrast characteristic with the first color of the upper face 136, such as black on white, yellow on black, white on blue, etc.

The hand 140 also preferably has a glossy characteristic, while the upper face 136 has a matte finish, so that the hand 140 is set off and further contrasts with the upper face 136. In other embodiments, the hand 140 has a matte finish and the upper face 136 has a glossy finish.

Referring to FIG. 7, the hand 140 is low and flat, and rotates in smooth, sliding contact against the upper face 136 of the top 135 of the cap 134. In other embodiments, the hand 140 may be raised significantly with respect of the upper face 136. The hand 140 is coextensive to the top 135 of the cap 134, and the hand 140 has opposed ends 142 and 143, which are beveled and terminate at the perimeter of the cap 134. The cap 134 has a sidewall 144 depending from the top 135 to an opposed bottom 145. Two circumferential lips are formed on the sidewall 144 and extend radially outward; an upper lip 150 formed proximate to the top 135 and a lower lip 151 formed proximate to the bottom 145.

The cap 134 is generally hollow, having an interior volume defined between the sidewall 144, the top 135, and the bottom 145, but for a stem 152 depending from the top 135 of the cap 134. The stem 152 is cylindrical and extends downward from the top 135 of the cap 134. In some embodiments, the stem 152 terminates within the interior volume; in the embodiment shown in FIG. 7, the stem 152 extends just below the bottom 145. The stem 152 receives and holds a shaft 153 of the hand 140. The hand 140, which slides against the flat upper face 136, includes a cylindrical shaft 153 depending from a bottom of the hand 140 downward through a hole in the cap 134 formed in communication with the stem 152. The shaft 153 is formed integrally to the hand 140 and terminates in a lower end 154 fitted with a bevel gear 155. The bevel gear 155 is an external bevel gear and is preferably permanently secured to the lower end 154 of the shaft 153 such as with adhesive. The bevel gear 155 is fit onto the shaft 153 such that the bevel gear 155 is received in juxtaposition with the lower end of the stem 152. In this way, the bevel gear 155 prevents the hand 140 from lifting off of the flat upper face 136 because the bevel gear 155 interacts with the lower end of the stem 152. When the bevel gear 155 is permanently secured to the shaft 153, the hand 140 is permanently mounted for rotation with respect to the cap 134.

Still referring to FIG. 7, the base 133 is a cylindrical base with an internal volume 160 for holding and protecting electronic and mechanical drive components. The base 133 has an open top 161, an opposed bottom 162, and a cylindrical sidewall 163 extending between the top 161 and bottom 162 and enclosing the internal volume 160. The base 133 has an outer diameter J of the sidewall 163 which is constant between the top 161 and bottom 162 and coextensive with the upper lip 150 of the cap 134, and an inner diameter K of the sidewall 163 which is also constant between the top 161 and bottom 162, and which is coextensive with the sidewall 144 of the cap 134.

The base 133 is formed by first and second base portions 164 and 165. Each base portion 164 and 165 is roughly half the size of the entire base 133, but it should be understood that the invention is not limited to base portions 164 and 165 which are exactly half the size of the entire base 133. The base portions 164 and 165 are opposed and releasably secured and coupled to each other to form the base 133. When coupled, the base potions 164 and 165 cooperate to define the base 133 with the sidewall 163. An annular channel 170 extends continuously around an inner face 171 of the sidewall 163. The channel 170 is a generally rectangular groove extending into the sidewall 163 from the inner face 171, and is disposed proximate to the bottom 162 of the base 133. Another annular channel, identified here as a snap channel 172, extends continuously around the inner face 171 of the sidewall 163 as well. The snap channel 172 is a generally rectangular groove extending into the sidewall 163 from the inner face 171, and is disposed above the channel 170 just below the top 161 of the base 133. The snap channel 172 is sized to receive the lower lip 151 when the marker 131 is assembled; the lower lip 151 snaps into and is held within the snap channel 172. When fitted in this position, the upper lip 150 lies over and is seated in continuous annular contact against the top 161 of the base 133.

Inside the base 133, the internal volume 160 contains and protects the electronic and mechanical drive components. A circular printed circuit board ("PCB") 173 is seated within the channel 170 and held in place, disposed just above the bottom 162 of the base 133 in the channel 170. The channel 170 is sized to snugly receive the PCB 173. The PCB 173 is fixed in the channel 170 on the first portion 164, such as by adhesive, and is only snugly fit into the channel 170 on the second portion 165, so that, when the first and second portions 164 and 165 are detached from each other, the PCB 173 remains applied to the first portion 164, but when the first and second portions 164 and 165 are fitted against each other, the PCB 173 snugly retains the second portion 165 against the first portion 164. The PCB 173 carries a battery 174, programmable logic 175, a receiving unit 176, and circuit paths 177 connecting the battery 174, logic 175, and receiving unit 176. The battery provides power to the logic 175 and to the receiving unit 176, which is coupled in wireless communication, such as RF communication, with the remote 132. Mounted atop the PCB 173 is also the motor 180. The motor 180 is a drive motor having a shaft 181 and a bevel gear 182 spaced apart from the motor 180 by the shaft 181 and above the PCB 173. The motor 180 is preferably a DC motor which converts direct current electricity provided by the battery 174 into mechanical rotational movement of the shaft 181. The shaft 181, mounted for rotation in and by the motor 180, extends laterally and parallel with respect to the PCB 173 into the bevel gear 182. When the marker 131 is assembled, the bevel gears 155 and 182 meshingly engage so that rotation of the shaft 181 by the motor 180 imparts rotation to the hand 140 with respect to the upper face 136 of the cap 134.

With reference now to both FIGS. 6 and 7, the battery 174 within the internal volume 160 is electrically coupled to the motor 180 and powers the motor 180 in response to the golfer's commands. Commands are issued from the golfer by operating the remote 132. The remote 132 has two inputs, illustrated in FIG. 6 as buttons 183 and 184. Depression of buttons 183 and 184 will cause the hand 140 to rotate incrementally with respect to the cap 131 in a clockwise or counter-clockwise direction, respectively. The remote 132 has a transmitter 185, such as a radio transmitter, which, in response to depression of either one of the buttons 183 and 184, transmits a signal 186 to the marker 131. The remote 132 may also include other buttons, such as to turn the marker 131 on, off, or to standby. The receiver 176 on the PCB 173 within the internal volume 160 receives the signal 186, and the programmable logic 175 coupled to the receiver 176 converts the signal 186 into an electrical pulse to the motor 180. Preferably, depression of the button 183 is converted into a single electrical pulse to the motor 180 rotating the hand 140 in a clockwise direction. Similarly, depression of the button 184 is converted into a single electrical pulse to the motor 180 rotating the hand 140 in a counter-clockwise direction. In this way, the golfer can incrementally rotate the hand 140 in discrete, very small clockwise or counter-clockwise increments, such as movements of approximately one degree. Continuous, slow movement can be instructed by depressing and holding down one of the buttons 183 and 184.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A putting alignment device for aiding in hitting a golf ball, the putting alignment device comprising:

a base;

a cap mounted to the base;

alignment indicia on the cap indicating a target line for putting the golf ball; and a remote control unit coupled in communication to the base, wherein the alignment indicia on the cap rotates with respect to the base in response to a signal communicated from the remote control unit.

2. The putting alignment device of claim 1, wherein the alignment indicia is displayed by an electronic visual display.

3. The putting alignment device of claim 1, wherein the cap includes a peripheral bevel bounding the upper surface, and the alignment indicia extends beyond the upper surface onto the bevel.

4. The putting alignment device of claim 1, wherein the cap includes a flat upper surface having a first color, the alignment indicia is a line formed across the upper surface marked in a second color contrasting with the first color, and a motor in the base rotates the cap with respect to the base in response to the signal communicated from the remote control unit so as to rotate the alignment indicia.

5. The putting alignment device of claim 4, wherein the base includes a bottom, a top, and an annular sidewall extending between the bottom and top, wherein the base is formed by a first base portion releasably secured to a second base portion, wherein the base further includes a channel formed into the sidewall of the base and a circuit board seated into the channel in the base, wherein the circuit board includes a receiving unit coupled in communication to the remote control unit for communication with the base, and wherein the motor is operatively coupled to the circuit board and to the cap to impart rotation to the cap in response to the receiving unit receiving the signal from the remote control unit.

6. The putting alignment device of claim 5, wherein the circuit board is permanently secured to the first base portion of the base and is releasably fit to the second base portion.

7. The putting alignment device of claim 5, wherein the first and second base portions of the base include first and second spars, respectively, extending across the top of the device and cooperating to form a brace including a central collar, wherein the cap includes a shaft extending downward to a gear, the shaft of the cap is received through the central collar of the brace, and the gear on the shaft is operatively coupled to the motor in the base, and wherein interaction of the collar with the gear prevents relative lateral and vertical movement of the cap with respect to the base.

8. A putting alignment device for aiding in hitting a golf ball, the putting alignment device comprising:

a base;

a cap mounted to the base for rotation with respect to the base;

alignment indicia on the cap indicating a target line for putting the golf ball;

a remote control unit coupled in communication to the base; and a drive assembly in the base that rotates the cap with respect to the base in response to a signal communicated from the remote control unit.

9. The putting alignment device of claim 8, wherein the cap includes a flat upper surface having a first color, and the alignment indicia is a line across the upper surface marked in a second color contrasting with the first color.

10. The putting alignment device of claim 9, wherein the cap includes a peripheral bevel bounding the upper surface, and the indicia extends beyond the upper surface onto the bevel.

11. The putting alignment device of claim 8, wherein the base includes a bottom, a top, and a continuous sidewall extending therebetween with an inner surface, wherein the base is formed by a first base portion releasably secured to a second base portion, wherein the base further includes a channel formed into the inner surface of the sidewall of the base and a circuit board seated into the channel in the base wherein the circuit board includes a receiving unit coupled in communication to the remote control unit for communication with the base, and wherein the drive assembly in the base includes a motor operatively coupled to the circuit board and to the cap to impart rotation in response to the receiving unit receiving the signal from the remote control unit.

12. The putting alignment device of claim 11, wherein the circuit board is permanently secured to the first base portion of the base and is releasably fit to the second base portion.

13. The putting alignment device of claim 11, wherein the first and second base portions of the base include first and second spars, respectively, extending across the top of the device and cooperating to form a brace including a central collar, wherein the cap includes a shaft extending downward to a gear, the shaft of the cap is received through the central collar of the brace, and the gear on the shaft is operatively coupled to the motor in the base, and wherein interaction of the collar with the gear prevents relative lateral and vertical movement of the cap with respect to the base.

14. The putting alignment device of claim 8, wherein an element of the drive assembly is carried in the base and a complemental element of the drive assembly is carried on the cap.

15. The putting alignment device of claim 8, further including an engagement assembly holding the cap onto the base, the engagement assembly including:

a first gear carried by the cap, a second gear carried by the base and meshingly engaged to the first gear, and a collar on the base fit above the first gear, the collar preventing movement of the first gear out of meshing engagement with the second gear and simultaneously preventing movement of the cap off the base.

16. The putting alignment device of claim 8, wherein the cap includes a flat upper surface having one of a matte and glossy finish, and the alignment indicia includes the other of the matte and glossy finish.

17. A putting alignment device for aiding in hitting a golf ball, the putting alignment device comprising:

a base;

a cap mounted to the base;

alignment indicia on the cap indicating a target line for putting the golf ball, the alignment indicia including comprising a hand mounted for rotation with respect to the cap;

a remote control unit coupled in communication to the base; and a drive assembly in the base coupled to the hand to rotate the hand with respect to the cap in response to a signal communicated from the remote control unit.

18. The putting alignment device of claim 17, wherein the cap includes a flat upper surface having a first color, and the hand includes a second color contrasting with the first color.

19. The putting alignment device of claim 17, wherein the cap includes a flat upper surface having one of a gloss and matte finish, and the hand includes the other of the gloss and matte finish.

20. The putting alignment device of claim 17, wherein the base includes a bottom, a top, and a continuous sidewall extending therebetween with an inner surface, wherein the base is formed by a first base portion releasably secured to a second base portion, wherein the base further includes a channel formed into the inner surface of the sidewall of the base, and a circuit board seated into the channel in the base, wherein the circuit board includes a receiving unit coupled in communication to the remote control unit for communication with the base, and wherein the drive assembly in the base includes a motor operatively coupled to the circuit board and to the hand to impart rotation to the hand with respect to the cap in response to the receiving unit receiving the signal communicated from the remote control unit.

* * * * *